United States Patent [19]

Johnson et al.

[11] 3,968,959

[45] July 13, 1976

[54] DOCUMENT TRANSPORT AND SEPARATING DEVICE

[75] Inventors: Oliver Duane Johnson, Austin, Tex.; Frederick Fenn Quist, Jr., Boulder, Colo.

[73] Assignee: International Business Machines Corporation, Armonk, N.Y.

[22] Filed: Dec. 31, 1974

[21] Appl. No.: 537,732

[52] U.S. Cl. ..... 271/137; 271/140

[51] Int. Cl.[2] ..... B65H 3/42; B65H 3/46

[58] Field of Search ..... 271/42, 122, 128, 130, 271/137, 139, 140, 250, 266, 267

[56] References Cited

UNITED STATES PATENTS

| | | | |
|---|---|---|---|
| 2,707,569 | 5/1955 | Benson | 271/42 |
| 3,744,789 | 7/1973 | Kolibas | 271/42 |
| 3,747,921 | 7/1973 | Knappe | 271/266 |
| 3,773,317 | 11/1973 | Kummerer | 271/122 |

FOREIGN PATENTS OR APPLICATIONS

| | | | |
|---|---|---|---|
| 922,780 | 4/1963 | United Kingdom | 271/122 |

*Primary Examiner*—Evon C. Blunk
*Assistant Examiner*—Robert Saifer
*Attorney, Agent, or Firm*—John L. Jackson

[57] ABSTRACT

A document transport and separating device which utilizes opposing intermittent motion imparting devices having tips, the end of which are caused to move in an elliptical manner to feed, separate and align documents such as sheets of paper. One end of the tips of the devices are caused to move in an elliptical manner through a combination of application of an intermittent force parallel to the longitudinal axis of the tips of the device at its other end coupled with a rotational movement about a mounting spring which converts the longitudinal force into the elliptical motion. The longitudinal force is applied by pulsing a solenoid or electro magnet. The tips of the opposing devices are flattened at their point of intermediate contact to prevent multiple sheet feeding and greater surface contact and the coefficients of friction of the flattened tip surfaces are greater than the coefficients of friction between each of the sheets such that sheet feeding occurs. However, the coefficient of friction of the upper or feeding tip is greater than that of the lower or restraining tip to provide the dual function of both separating and transporting a sheet. Alignment of the tips such that the elliptical rotation of their ends is at an angle to the path of the paper allows alignment of a sheet of paper against a transport rail for both proper separating, transporting and alignment of a sheet.

2 Claims, 6 Drawing Figures

DOCUMENT TRANSPORT AND SEPARATING DEVICE

BACKGROUND OF THE INVENTION

1. Field of the Invention

This invention relates to document transporting devices in general and more particularly to a document transporting device employing opposing intermittent motion imparting devices such as are generally described in U.S. Pat. No. 3,747,921, to L. F. Knappe, entitled "Document Feed Device", which is herein incorporated by reference.

2. Description of the Prior Art

Document transport devices including separator mechanisms to prevent multiple sheet feeds, normally are of the type in which rollers are utilized to transport the documents or sheets to a picker separator station. Again, at the picker separator station rollers rotating in opposing directions are utilized to feed the sheet on the top of a stack of paper while restraining the other sheets beneath the top sheet. While these devices can be made to work satisfactorily they suffer from the fact that since the rollers are in continuous contact they are susceptible to both wear, which allows multiple sheet feeding or a malfunction of the sheet feeding itself, coupled with a film buildup which results in unreliable feeding. In the above-referenced U.S. Pat. No. 3,747,921, there is described in the basic intermediate motion imparting device. In the description of this patent, however, only one method of operation was described. It was felt, at the time of the filing of the patent, that the intermittent motion or elliptical motion which caused the extremity of the tip to lift on and off of a sheet of paper to provide the intermittent motion was due to the shape of the tip. Subsequent investigation, however, has resulted in a determination that the elliptical motion also can be provided by the spring mounting itself which imparts a rotational motion to the longitudinal motion which results in the elliptical movement. In addition, it has been determined that the non-symmetrical wedge shape of the tip as far as obtaining an elliptical motion is not important and that many different shapes of tips can be utilized.

SUMMARY OF THE INVENTION

A document transport and separating device which utilizes opposing intermittent motion imparting devices having tips, the ends of which are caused to move in an elliptical manner to feed, separate and align documents such as sheets of paper. One end of the tips of the devices are caused to move in an elliptical manner through a combination of application of an intermittent force parallel to the longitudinal axis of the tip of the device at its other end coupled with a rotational movement about a mounting spring which converts the longitudinal force into the elliptical motion. The longitudinal force is applied by pulsing a solenoid or electro magnet. The tips of the opposing devices are flattened at their point of intermediate contact to prevent multiple sheet feeding and greater surface contact and the coefficients of friction of the flattened tip surfaces are greater than the coefficients of friction between each of the sheets such that sheet feeding occurs. However, the coefficient of friction of the upper or feeding tip is greater than that of the lower or restraining tip to provide the dual function of both separating and transporting a sheet. Alignment of the tips such that the elliptical motion of their ends is at an angle to the path of the paper allows alignment of a sheet of paper against a transport rail for both proper separating, transporting and alignment of a sheet. The intermittent and simultaneously applied force additionally allows the release of the aligning force each cycle and thus avoids damaging the paper. Also, the intermittent and simultaneously applied force from the top and bottom intermediate motion imparting device tips assist in breaking apart virgin paper and paper sheets having a rough surface finish.

The electrical pulses which drive the tips into contact with the paper are applied simultaneously to each of the solenoids and the springs which move the tip out of contact are chosen such that the flattened ends contact the top and bottom of a sheet being fed at the same time to assure accurate feeding of the sheet being fed and blockage of all other sheets in the paper stack.

DESCRIPTION OF THE PREFERRED EMBODIMENT

Figure 1:
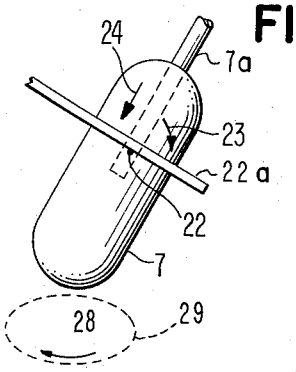
In FIG. 1 there is shown a device tip and spring illustrating the conversion of the longitudinal force applied to the tip at its upper end into an elliptical pattern or motion at the end which is to be adjacent a sheet of paper.

In FIG. 1 there is shown an intermittent motion imparting device tip and mounting spring for illustrating the conversion of the longitudinal motion applied to the device into an elliptical pattern at the extreme tip of the device to illustrate that the tip of the device moves down onto a document to be fed and then moves off of it in an intermittent pattern such that feeding occurs. The tip in FIG. 1 would create an elipse 29 which would cause feeding of a sheet of paper under it in the direction indicated by arrow 28. The size of the ellipse may vary but one 0.050 inches in height by 0.100 inches in length has been found to be satisfactory. As illustrated in FIG. 1 by the arrow 24, the tip 7 is caused to move back and forth in a longitudinal direction at the top of the device by applying power to the mounting shaft 7*a* which will be described in detail in connection with FIG. 2. The device has a return spring 22*a* and as illustrated by the arrow 23, the device tends to rotate as the spring is deflected. The conversion of the longitudinal and rotational vectors to form the ellipse 29 is also dependent on the choice of material for the tip 7. That is, there is a mechanical delay introduced by the material which is a RTV (room temperature vulcanizable) silicone rubber. At point 22 the tip is moving almost entirely in a longitudinal or rectilinear motion. As the vectors equivalent motion moves down the tip points on the longitudinal axis move or become progressively more elliptical with the final ellipse occuring at the lower end.

Figure 2:
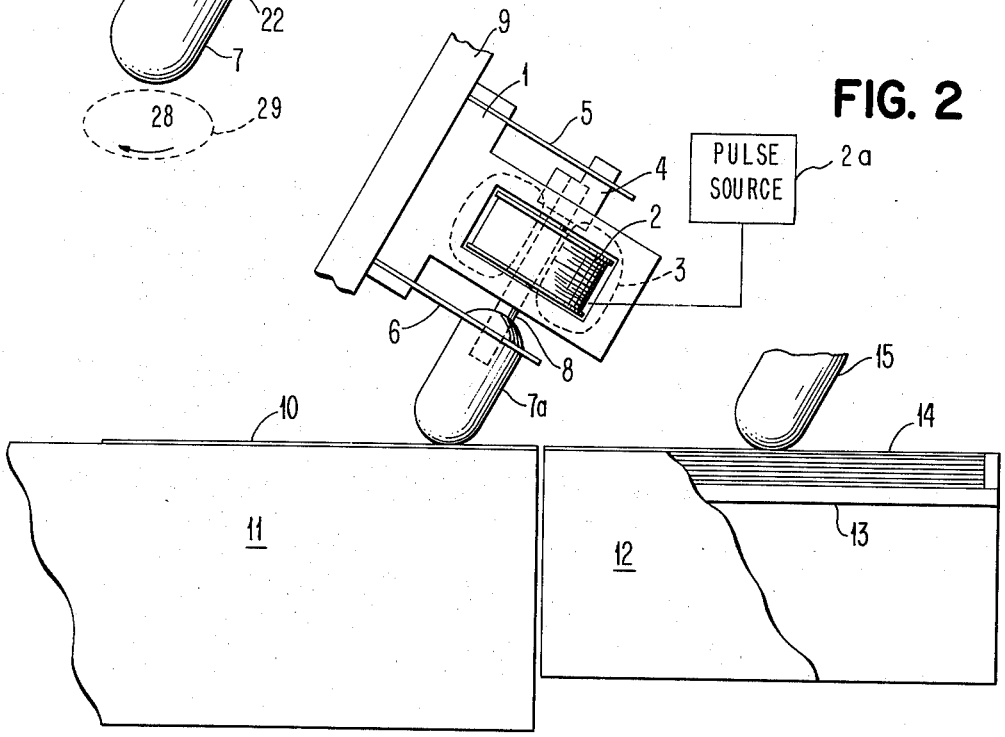
In FIG. 2 there is shown a document hopper, motion imparting device and transport device employing intermittent motion imparting devices.

In FIG. 2 there is shown a more complete system, but one in which the tips again are caused to move in an elliptical pattern to come into intermediate contact with the paper such that the paper is moved in small increments each time the tip comes into contact with the paper. As shown in FIG. 2, there is a support wall or mount 9 to which the frame 1 is connected. As above described, the intermittent motion imparting device is quite similar in many ways to a small electrical motor. The intermittent motion imparting device converts electrical power to produce mechanical motion and consists of the frame 1, an electrical coil 2, an electrical flux path 3, an armature 4, spring supports for the armature assembly 5 and 6, and an elastomer tip 7*a*. In addition, there is included a shaft 8 to which the device 7*a* is connected and this shaft is caused to move in a longitudinal direction by application of pulses to the electric coil 2 by means of a power source not shown. The motion imparting device may be a solenoid or electro-magnet and need only be strong enough to overcome the spring force presented by springs 4 and 6. However, since the load is inductive to assure good operation, the current applied to the coil 2 should have a relatively fast fall time to allow the springs 4 and 6 to lift the tip. A good pulse source 2*a* is shown and described in application Ser. No. 537,731, entitled, "Document Transfer Device Drive", by Errol R. Williams and J. R. Kinnard, filed on the same day as the present invention and having a common assignee.

In addition, as shown in FIG. 2, there is a paper hopper 12 including a number of sheets of paper supported on a sheet support 13 which may be moved upwardly by means not shown as sheets are fed. The top sheet of the paper 14 is intermittently contacted by the elastomer 15 in a manner as described in connection with FIG. 1 and the description just previously given. As shown in FIG. 2 there is another device which was previously described which comes into intermediate contact with a sheet of paper 10 which has been fed, which is supported on paper support 11. This is the usual feed path in intermittent motion transport devices. The problem with the device or system of FIG. 2 is that as is obvious, there could be multiple sheet feeding which is highly undesirable in sheet feeding systems due to the fact that jams and other problems can occur.

Figure 3:
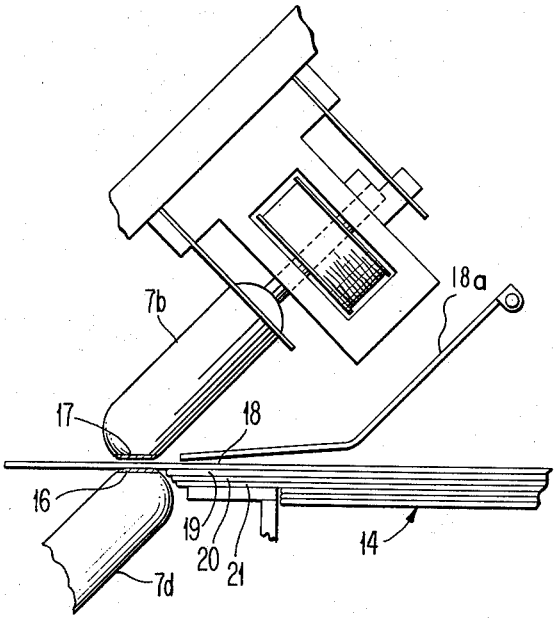
In FIG. 3 there is shown the preferred embodiment of the sheet separator, transport and alignment device.

In FIG. 3 there is shown the preferred embodiment for assuring that single sheets are in fact picked, fed and aligned. In FIG. 3 there is shown an intermittent motion transport device which is operative in the manner as described in association with FIGS. 1 and 2, and thus, each of the elements will not be again described. In addition for purposes of simplicity, the tip 7*d* is not shown as having a driving device, however, it is driven in the same manner by an armature coil, etc., as described in connection with FIG. 2 such that it likewise moves in an elliptical manner. The upper tip 7*b* has a flattened surface 17 while the lower tip 7*d* has a flattened surface 16. As can be seen in FIG. 3, there is a paper guide device 18*a* to direct the sheets between the opposing tips.

To assure that only single sheets of paper are fed, the coefficient of friction between the tips 16 and 17 is made such that it is greater than that between the sheets 19, 20 and 21 in the stack of paper 14. Further to assure that only the upper sheet is fed, the coefficient of friction between the tips 16 and 17 is chosen such that the coefficient of friction of tip 17 is greater than that of tip 16. Thus, a combination of the selection of the coefficient of frictions of the tips flattened surface coupled with the fact that the flattening results in an impairment to the feeding of the second and third sheets results in assuring that single sheets only are fed. The materials coated of the ends of the tips may be castable urethane and may be approximately 0.005 "thick".

The reason for requiring that the coefficient of friction of coating 17 be greater than that of coating 16 is that, as above described, the spring forces, the current waveform and time of application of the electrical pulse are chosen such that the flat surfaces meet simultaneously. That is, ideally they will contact the top and bottom of the sheet of paper 18 simultaneously in near perfect alignment which results in the flattening out of the lower portion of the ellipse associated with surface 17 and the upper portion of the ellipse associated with surface 16. This results in (1) providing surface 17 a good paper support, e.g. surface 16 and (2) allows tip 7*d* to be in a good blocking position relative to the other sheets in the stack.

Figure 4:
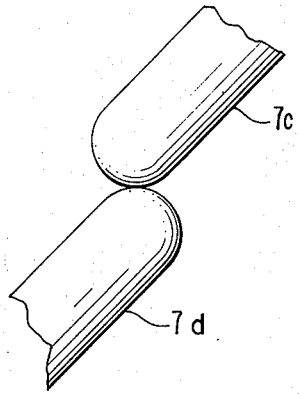
In FIG. 4 there is shown another embodiment of a sheet separator, feed and alignment device.

In FIG. 4 there is again shown another embodiment which can be made to work. Again, these tips 7*c* and 7*d* are moved in an elliptical manner at their extremities such that they tend to pick and separate single sheets. However, the system of FIG. 4 is not as desirable as that of FIG. 3 in that there is no flattening of the tips nor any addition of special materials. With respect to desired coefficients of friction, it would be obvious that the materials chosen should meet the general criteron set forth in connection with the discussion of FIG. 3. In addition, obviously means for driving the sheets into and pulling the sheets from the separator would be required.

Figure 5:
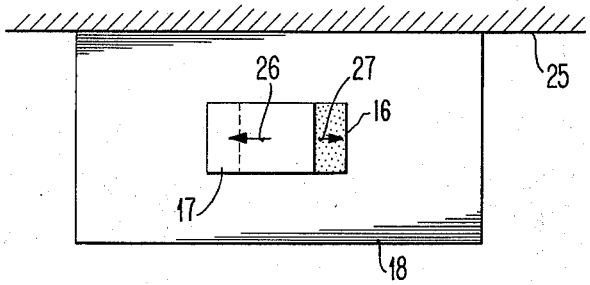
In FIG. 5 there is shown an illustration of the devices in alignment such that their elliptical patterns move in a direction parallel to the guide plate of the paper support mechanism.

In FIG. 5 there is shown a top view of the alignment of the tips. The upper tip 17 is shown offset from the lower tip 16. As illustrated, the elliptical paths move in the direction of arrows 26 and 27 in opposite directions such that the upper sheet of the stack of paper 18 tends to move to the left while a restraining motion as illustrated by arrow 17 is applied to any subsequent sheets which may be attempted to be fed. These two feeding directions, as illustrated by arrows 26 and 27, are parallel to the alignment plate 25. However, proper alignment or biasing against the alignment plate is not assured in the embodiment of FIG. 5.

Figure 6:
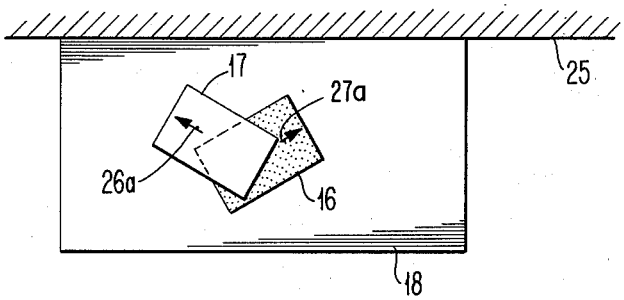
In FIG. 6 there is shown a skewing of the elliptical patterns of the devices such that both the top sheet to be picked and fed and the trailing sheet are forced into alignment with the guide rail of the paper support device.

In FIG. 6 there is shown the preferred embodiment of alignment of the tips. In FIG. 6 the upper tip 17 is skewed with respect to the plate 25 such that the upper sheet is driven in the direction as illustrated by the arrow 26*a* into good alignment or contact with the plate 25 while at the same time the lower tip 16 is skewed with respect to the plate 25 and is caused to move in the direction in an elliptical manner as illustrated by arrow 27*a*. Thus, in this manner, both the top sheet and any sheet which may be attempted to be fed are both biased against the alignment plate 25 such that good alignment and single sheet feeding occurs.

In summary, a document transport and separating device which utilizes opposing intermittent motion imparting devices having tips, the ends of which are caused to move in an elliptical manner to feed, separate and align documents such as sheets of paper. One end of the tips of the devices are caused to move in an elliptical manner through a combination of application of an intermittent force parallel to the longitudinal axis of the tip of the device at its other end coupled with a rotational movement about a mounting spring which converts the longitudinal force into the elliptical motion. The longitudinal force is applied by pulsing a solenoid or electro-magnet. The tips of the opposing devices are flattened at their point of intermediate contact to provide greater surface contact and the coefficients of friction of the flattened tip surfaces are greater than the coefficients of friction between each of the sheets that sheet feeding occurs. However, the coefficient of friction of the upper or feeding tip is greater that that of the lower or restraining tip to provide the dual function of both separating and transporting a sheet. Alignment of the tips such that the elliptical rotation of their ends is at an angle to the path of the paper allows alignment of a sheet of paper against a transport rail for both proper separating, restraining, transporting and alignment of a sheet.

While the invention has been particularly shown and described with reference to a preferred embodiment thereof, it will be understood by those skilled in the art that the foregoing and other changes in form and details may be made therein without departing from the spirit and scope of the invention.

What is claimed is:

1. A sheet separator, transport and alignment device capable of feeding, transporting and aligning a single sheet from a stack of sheets responsive to a source of electrical pulses, said device comprising:

means for driving sheets of paper from said stack;

separator restraint means associated with said means for driving for receiving sheets driven thereby;

said separator restraint means comprising a pair of intermittent motion imparting means responsive to said source of electrical pulses including tips being mounted one above the other each having substantially flat ends which are moved in a substantially elliptical path with the upper tip end being rotated in a direction at the lower portion of said ellipse as said tip end is moving in the desired direction of transport of said sheet and in contact therewith and the end of the tip of said other intermittent motion imparting device being rotated in a direction opposite to said desired direction of transport of said sheet at the upper portion of its said ellipse such that the lower portion of the upper tip and the upper portion of the lower tip reach their lower most and upper most positions substantially simultaneously by timewise controlling the application of said electrical pulses; and each said intermittent motion imparting means including a solenoid mounted on a frame with its armature being driven in a rectilinear manner in the direction of said paper by said electric pulses being applied to its windings at least one spring for returning said armature in the opposite direction with said spring being mounted on said frame such that the longitudinal motion of the portion of said tip farthest from said paper is converted at the opposite end thereof to said substantially elliptical path.

2. The sheet separator, transport and alignment device of claim 1 wherein the movement of said tip changes from a substantially longitudinal motion at the said end farthest away from said paper progressively in increments down said tip finally into said substantially elliptical path.

* * * * *